US005725264A

United States Patent [19]

Villarreal

[11] Patent Number: 5,725,264

[45] Date of Patent: Mar. 10, 1998

[54] DOORKNOB ATTACHMENT

[76] Inventor: Louis B. Villarreal, 812 Prado, San Antonio, Tex. 78225

[21] Appl. No.: 736,805

[22] Filed: Oct. 25, 1996

[51] Int. Cl.[6] ..... E05B 1/00

[52] U.S. Cl. ..... 292/347; 292/350

[58] Field of Search ..... 292/347, DIG. 2, 292/336.3, 350; 16/114 R; 74/557, 544

[56] References Cited

U.S. PATENT DOCUMENTS

| | | | |
|---|---|---|---|
| D. 219,861 | 2/1971 | Coofman | D8/138 |
| D. 268,984 | 5/1983 | Bergen | D8/308 |
| D. 295,605 | 5/1988 | Leopoldi | D8/321 |
| 2,801,122 | 7/1957 | Sutter . | |
| 2,942,909 | 6/1960 | Chase . | |
| 3,549,184 | 12/1970 | Anderson | 292/347 X |
| 3,575,453 | 4/1971 | Hohl . | |
| 3,827,739 | 8/1974 | Overholser . | |
| 4,018,465 | 4/1977 | Ramler | 292/347 X |
| 4,223,931 | 9/1980 | Neary . | |
| 4,285,536 | 8/1981 | McCoy et al. . | |
| 4,648,643 | 3/1987 | Bettger | 292/347 |
| 5,231,731 | 8/1993 | Jones, Jr. | 292/347 |
| 5,288,166 | 2/1994 | Donofrio | 292/347 X |

*Primary Examiner*—Rodney M. Lindsey
*Attorney, Agent, or Firm*—Gunn, Lee & Miller, P.C.

[57] ABSTRACT

A device for attaching to a doorknob and a method for attaching the device to the doorknob, the device comprising a body having two arms and an elongated handle member with a removed end and a near end, a pin extending from the body between the two arms, and fastener means for engaging the surface of the doorknob after the pin has been inserted therein for holding the body to the doorknob.

11 Claims, 2 Drawing Sheets

DOORKNOB ATTACHMENT

FIELD OF THE INVENTION

A device for attaching to a doorknob, more specifically, a lever for attaching to a doorknob through the use of a centrally-located pin and set screws on two arms extending from the body of the lever and partially enclosing the doorknob.

BACKGROUND OF THE INVENTION

Doorknobs are typically circular in outline and are rotated to latch and unlatch a door. However, it is often advantageous, especially to the handicapped, to utilize a door lever extending horizontally out from the axis of rotation of the doorknob through which to actuate the door closure mechanism.

In updating or remodeling older buildings, it is often helpful to provide for a lever that mounts to a doorknob rather than replacing the doorknob with a new lever mechanism.

Typical of the patents disclosing doorknob extension levers is U.S. Pat. No. 2,801,122 (Sutter, issued Jul. 30, 1957). This patent discloses an extension handle which attaches to the shaft or collar of the doorknob and partially encloses the doorknob. Another patent disclosing a door handle may be found in U.S. Pat. No. 3,575,453 (Hohl, issued Apr. 30, 1971). In the Hohl patent, the lever is attached to the doorknob through the use of a threaded bolt that compresses a wrap-around member against the surface of the doorknob. Yet a third approach to mounting a lever to a doorknob may be found in U.S. Pat. No. 3,827,739 (Overholser, issued Aug. 6, 1974). The Overholser reference shows a lever having a clamp portion which encircles and presses against the surface of the doorknob.

As can be seen from the foregoing patents, there are a variety of ways of mounting levers to doorknobs. All, however, suffer from a failure to quickly and easily attach the lever to the doorknob so that it is held firmly thereto and will not slip under excessive torque applied to the handle.

OBJECTS OF THE INVENTION

Thus, it is the object of applicant's invention to provide for a door handle lever for quickly, easily, and securely mounting to the doorknob of a door.

SUMMARY OF THE INVENTION

This and other objects are provided for in a device for attaching to a doorknob comprising a body having an elongated handle member with two arms at one end forming a semicircular face portion with a hole near the removed ends of each arm and a pin inserted where the longitudinal axis of the body intersects the arms, the body for fastening to a doorknob by inserting the pin into a hole drilled in the doorknob and fastening to the doorknob through fasteners inserted through the holes in the two arms and into the doorknob.

DETAILED DESCRIPTION OF THE PREFERRED EMBODIMENT

Figure 1:
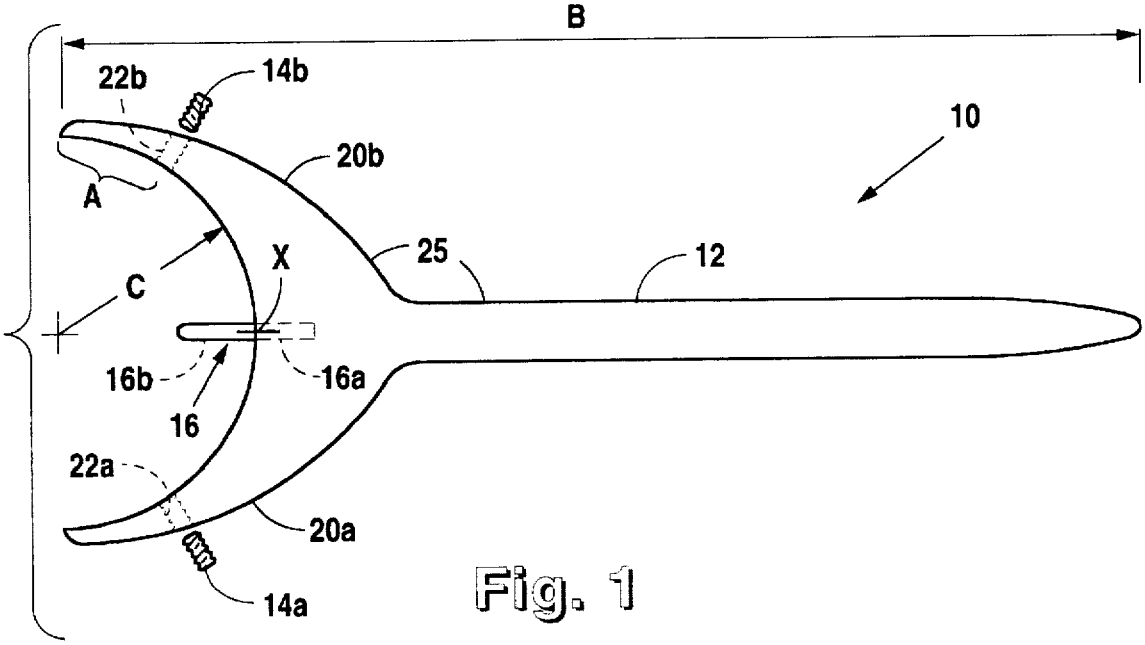
FIG. 1 is a side elevational view of the device of applicant's present invention.

FIG. 1 illustrates an elevational side view (left and right sides being identical) of doorknob lever (10) of applicant's present invention. More specifically, doorknob lever (10) is seen to be comprised of a body (12) with fastener means (14*a*) and (14*b*) insertable therethrough to fasten the body to a doorknob (Dk) (see FIGS. 4 and 5). Doorknob lever (10) is seen to include insertable into body (12) a pin (16) having an inserted end (16*a*) which may be threaded for insertion into the body and, typically, a pointed end (16*b*) protruding out from the body (12). Body (12) includes an elongated handle member (18) having a longitudinal axis thereto that is coincident with the longitudinal axis of pin (16).

Figure 4:
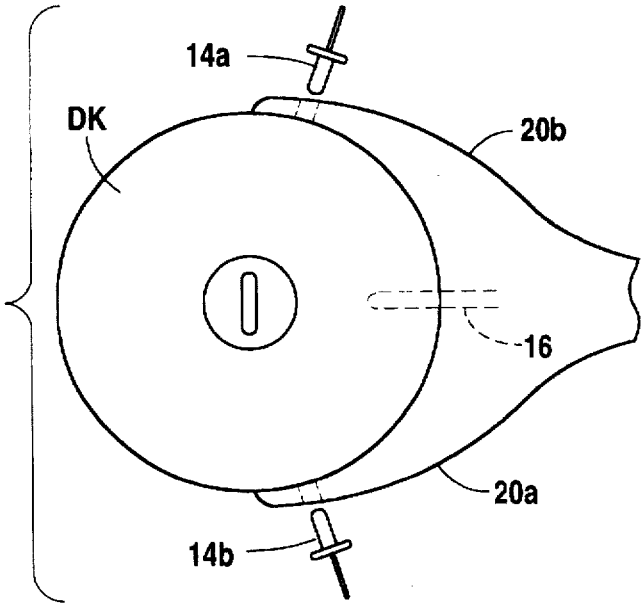
FIG. 4 is a side elevational view of applicant's device as mounted to a doorknob (Dk) through the use of pop rivets.

Body (12) is seen to have arms (20*a*) and (20*b*) extending from the near end thereof in a semicircular fashion so as to partially enclose doorknob (Dk) (see FIG. 4). Arms (20*a*) and (20*b*) have, near the removed ends thereof, holes (22*a*) and (22*b*), typically threaded but sometimes unthreaded. With threaded holes, threaded fasteners such as set screws illustrated in FIG. 1 at (14*a*) and (14*b*) or, when the holes are unthreaded, pop rivets as illustrated in FIG. 4 at (14*a*) and (14*b*). Fasteners are designed to be insertable into holes drilled in doorknob (Dk) as set forth more fully hereinbelow.

Figure 2A:
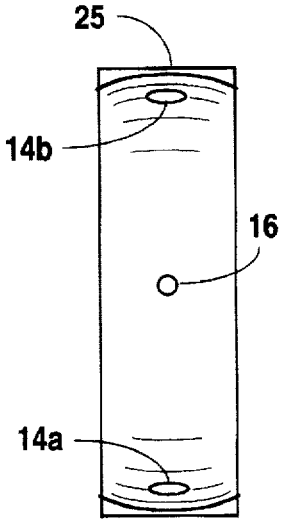
FIG. 2*a* is an elevational view of the end of the body of the device of applicant's present invention, which end contains the arms thereon, and which shows the arms with a curved face and having a flat outer surface.
Figure 2B:
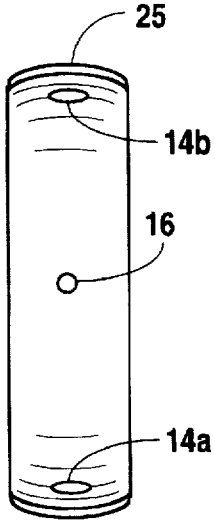
FIG. 2*b* is an elevational view of the end of the body of the device of applicant's present invention, which end contains the arms thereon, and which shows the arms with a curved face and having a curved outer surface.
Figure 3A:
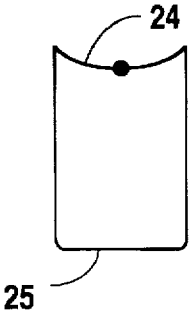
FIG. 3*a* is an elevational view of a cross section taken along plane (X), showing a concave face to the arms.
Figure 3B:
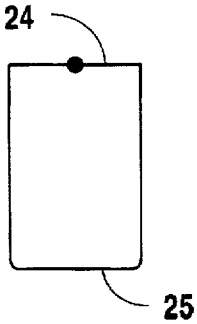
FIG. 3*b* is an elevational view of a cross section taken along plane (X), showing a flat face to the arms.

The views set forth in FIGS. 2*a*, 2*b*, 3*a*, and 3*b* illustrate a face (24) of body (12), the face being either straight (FIG. 3*b*) or slightly concave as set forth in FIGS. 2*a*, 2*b*, and 3*a*, so as to better fit the profile of the doorknob. While face (24) may be straight or concave, the outer surface (25) of the arms and/or handle portion (18) may be flat (FIGS. 2*a*, 3*a*, and 3*b*) or may be slightly rounded for a smoother appearance (FIG. 2*b*).

Body (12) could be molded or machined and may be made from: wood, aluminum, brass, steel, or plastic, or any other suitable material. The arms are typically semicircular so that a line drawn between the removed ends thereof goes through the center of radius or origin of the circle. The distance between the removed ends and the center of the holes (22*a*) and (22*b*) is typically between ¼" and 1¼", preferably ½". This distance is designated as (A) in FIG. 1. The letter (B) in FIG. 1 designates the entire length of body (12) from the tip of the arms to the tip of handle portion (18). This distance is preferably 6½" but may be in the range of 4" to 7½". Designated by the letter (C) in FIG. 1 is the radius of curvature of face (24) and this is typically 1⅛" but may be in the range from 1" to 1½". Pin (16) typically has a diameter of 3/32" and is inserted into an appropriately drilled hole, such as threading it in, and fixed by conventional means, such as with an adhesive like J-B Weld™.

Figure 5:
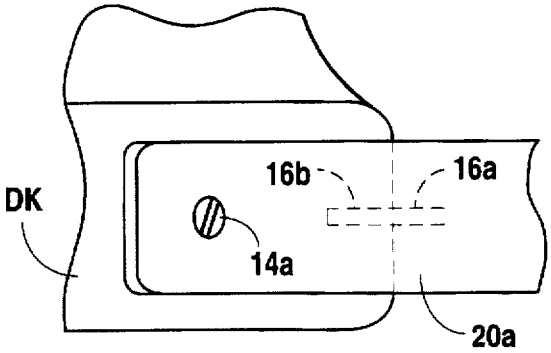
FIG. 5 is a top elevational view of applicant's device as mounted to a doorknob (Dk) through the use of set screws.

FIGS. 4 and 5 illustrate the mounting of doorknob lever (10) to doorknob (Dk). First, with the doorknob set in the neutral position (key at 12 o'clock/6 o'clock), the door handle is placed centrally against the outer surface of the doorknob so that pin (16) is at the 3 o'clock or 9 o'clock position (perpendicular to the key position). The end of handle portion (18) is then struck lightly so that pointed end (16*b*) marks or indents the surface of doorknob (Dk) at the appropriate location. The handle is then removed; and a hole, typically 3/32" in diameter, is drilled in doorknob (Dk) to snugly receive pin (16) therein. The handle is then mounted with the pin (16) in the drilled-out, center hole of the doorknob and the drill is placed at the appropriate locations near removed ends of arms (22*a*) and (22*b*) and drilling is commenced through the arms and into the doorknob to an appropriate depth. That hole may be countersunk. Faster means, either set screws (which require tapping holes (22*a*) and (22*b*) and holes in doorknob (Dk)) or pop rivets are placed through the holes into the doorknob. Inserting the set screws or popping the pop rivets fixes the door handle to the doorknob. The fixing of the device by set screws or pop rivets provides compression at the two removed points on the arms to hold the body to the doorknob. The pin, inserted into the doorknob at the centrally-located hole, helps prevent the doorknob from pivoting outward away from the door or inward toward the door and provides alignment between the doorknob and lever during the drilling of the arm holes (14*a*) and (14*b*).

Figure 6:
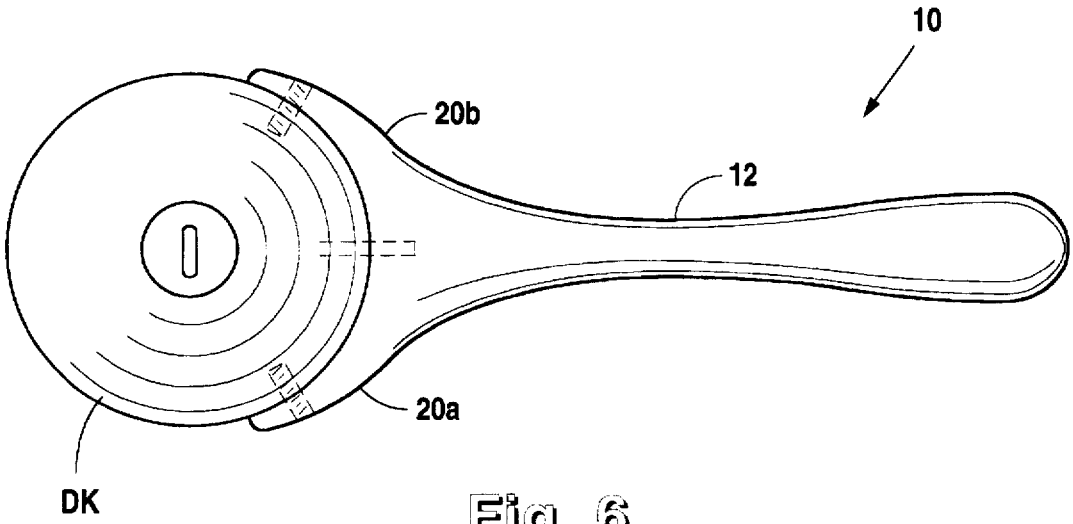
FIG. 6 is a side elevational view of an alternate preferred embodiment of applicant's present invention.

FIG. 6 is an alternate preferred embodiment of applicant's present invention. In this embodiment, arms (20*a*) and (20*b*) do not reach the semicircular configuration.

Applicant's invention provides a simple and easily installed doorknob lever with three points of contact, two providing compression and positive engagement between the lever and the door and the third to slide in through the hole to fix, along a horizontal plane, to the doorknob lever.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A device for attaching to a doorknob, the device comprising:

a rigid body, said body having two arms and an elongated handle member, the elongated handle member having a removed end and a near end, the near end joining the two arms, the two arms forming a semicircular face portion and each arm having a hole near a removed end thereof, wherein the longitudinal axis of the elongated handle member breaks the semicircular face portion midway between the removed ends of the two arms;

a pin having a longitudinal axis aligned with the longitudinal axis of the elongated handle member adjacent the handle member extending from the body at a point where the longitudinal axis of the elongated handle member intersects the semicircular face portion of the body; and fasteners insertable through the holes of the arms for engaging the surface of the doorknob after the pin has been inserted therein and for holding the body to the doorknob.

2. The device as set forth in claim 1, wherein said pin has a pointed, removed end.

3. The device as set forth in claim 1, wherein said body is comprised of steel.

4. The device as set forth in claim 1, wherein the holes in the arms of said body are threaded and said fasteners include set screws for threading into the arms of said body and into the doorknob.

5. The device as set forth in claim 1, wherein said fasteners are pop rivets.

6. The device as set forth in claim 1, wherein said body is comprised of plastic.

7. The device as set forth in claim 2, wherein the holes in the arms of said body are threaded and said fasteners include set screws for threading into the arms of said body and into the doorknob.

8. The device as set forth in claim 2, wherein said fasteners are pop rivets.

9. The device as set forth in claim 1, wherein said body is comprised of wood.

10. The device as set forth in claim 1, wherein said body is comprised of aluminum.

11. The device as set forth in claim 1, wherein said body is comprised of brass.

* * * * *